US012305954B2

(12) United States Patent
Schoonmaker et al.

(10) Patent No.: US 12,305,954 B2
(45) Date of Patent: May 20, 2025

(54) LOADING MECHANISM FOR AN AIR GUN

(71) Applicant: Moab Ventures LLC, Gravette, AR (US)

(72) Inventors: Geoffrey Schoonmaker, Rolla, MO (US); Joshua Matthew Isabell, Gravette, AR (US); Jacob Wagner, Centerton, AR (US)

(73) Assignee: MOAB VENTURES LLC, Bentonville, AR (US)

( * ) Notice: Subject to any disclaimer, the term of this patent is extended or adjusted under 35 U.S.C. 154(b) by 75 days.

(21) Appl. No.: 18/299,149

(22) Filed: Apr. 12, 2023

(65) Prior Publication Data

US 2023/0332860 A1 Oct. 19, 2023

Related U.S. Application Data

(60) Provisional application No. 63/363,060, filed on Apr. 15, 2022.

(51) Int. Cl.
*F41B 11/50* (2013.01)
*F41B 11/73* (2013.01)
*F41B 7/00* (2006.01)

(52) U.S. Cl.
CPC ..... *F41B 11/50* (2013.01); *F41B 11/73* (2013.01); *F41B 7/006* (2013.01)

(58) Field of Classification Search
CPC ..... F41B 11/50; F41B 11/73; F41B 11/00; F41B 11/70; F41B 11/89; F41B 7/006; F41B 7/08; F41A 3/12
USPC ..... 124/56; 446/176
See application file for complete search history.

(56) References Cited

U.S. PATENT DOCUMENTS 3,142,294 A * 7/1964 Baldwin, Jr. ..... F41B 11/647 124/52
3,765,396 A * 10/1973 Kienholz ..... F41B 11/50 124/53.5
4,288,938 A 9/1981 Kahn
4,674,217 A 6/1987 Matievich
(Continued)

FOREIGN PATENT DOCUMENTS

EP 2705322 B1 5/2016
RU 2118781 C1 9/1998
WO 2002090864 A1 11/2002

*Primary Examiner* — John E Simms, Jr.
(74) *Attorney, Agent, or Firm* — Heslin Rothenberg Farley & Mesiti P.C.

(57) ABSTRACT

A loading mechanism includes a housing including a loading chamber positioned adjacent to a housing passageway. The loading chamber is operable to load ammunition therein. A resilient bucking is disposed within the housing passageway. The bucking includes a bucking passageway that is operable to receive ammunition transferred from the loading chamber. A spring, having a plurality of spring coils, is disposed in the housing passageway. The spring is operable to apply pressure to the bucking when the spring is compressed. A gun barrel is slidably positioned within the housing passageway. A fastening mechanism is operable to attach the gun barrel to the housing and to put the spring into compression. When the spring is compressed, pressure is applied to the bucking and the bucking passageway is collapsed inward to seal entirely around ammunition that is positioned within the bucking passageway.

24 Claims, 6 Drawing Sheets

(56) References Cited

U.S. PATENT DOCUMENTS

| | | | | |
|---|---|---|---|---|
| 4,920,679 | A | 5/1990 | Sarles et al. | |
| 5,987,797 | A | 11/1999 | Dustin | |
| 7,975,417 | B2 | 7/2011 | Duplessis | |
| 9,383,155 | B2 | 7/2016 | Bero | |
| 2005/0188973 | A1* | 9/2005 | Monks | F41B 11/50 124/42 |
| 2008/0099004 | A1 | 5/2008 | Gerardo | |
| 2016/0076850 | A1* | 3/2016 | Sullivan | F41A 19/12 124/63 |
| 2016/0116244 | A1* | 4/2016 | Zou | F41B 7/08 124/83 |
| 2016/0209155 | A1 | 7/2016 | Dodson | |
| 2017/0176133 | A1 | 6/2017 | Sullivan | |
| 2019/0011217 | A1* | 1/2019 | Liao | F41B 11/70 |
| 2019/0072359 | A1 | 3/2019 | Teng et al. | |
| 2019/0128631 | A1 | 5/2019 | Tonkin | |
| 2020/0333097 | A1 | 10/2020 | Hendricks et al. | |
| 2022/0003518 | A1* | 1/2022 | Lort | F41B 11/70 |

* cited by examiner

LOADING MECHANISM FOR AN AIR GUN

CROSS REFERENCE TO RELATED APPLICATIONS

This application is a non-provisional of, and claims the benefit of the filing date of, U.S. provisional application 63/363,060, filed Apr. 15, 2022, entitled, "LOADING MECHANISM FOR AN AIR GUN," the contents of which are incorporated herein by reference in their entirety.

TECHNICAL FIELD

The present disclosure relates to loading mechanisms for guns. More specifically, the disclosure relates to loading mechanisms for loading ammunition into an air gun.

BACKGROUND

Loading mechanisms, such as "hop-up" systems, are used to "load" ammunition, such as BBs, into an air gun. Current loading mechanisms often utilize a resilient tubular structure, known as a bucking, that is positioned between an air nozzle and a barrel of an air gun. The bucking has an inner passageway that is designed to engage and provide resistance to a BB until the air nozzle can build up enough back pressure to launch the BB through the barrel of the air gun.

However, manufacturing tolerances, even minor manufacturing tolerances, can vary the amount of resistance that a bucking can apply to a BB or any other form of ammunition. Additionally, normal wear and tear of a bucking during usage can change the resistance applied by any given bucking to the ammunition. If the bucking becomes too worn, or the manufacturing deviations are too great, the bucking may not be able to apply enough resistance to the BB to build up the back pressure required for a proper launching of the BB.

Additionally, current air gun loading mechanisms often have little or no adjustment capability to the resistance that a bucking can apply to a BB. So, a bucking that becomes worn past its optimal design performance cannot be adjusted properly or cannot be adjusted at all. Further, a bucking that is designed for a certain air pressure supply through an air nozzle may not be adjustable to work with a different air pressure supply through the same air nozzle.

Accordingly, there is a need for a loading mechanism for an air gun that can adjust the amount of resistance applied by the bucking to the ammunition. Further there is a need to provide a fine enough adjustment to the resistance of the bucking to compensate for or eliminate the adverse effects caused by manufacturing tolerances, or wear and tear, on the bucking or other components of the loading mechanism.

BRIEF DESCRIPTION

The present disclosure offers advantages and alternatives over the prior art by providing a loading mechanism for an air gun, wherein an adjustable pressure can be applied to a bucking within the loading mechanism, wherein the bucking passageway is collapsed inward to seal entirely around ammunition that is positioned within the bucking passageway. The adjustable pressure to the bucking can be made fine enough to compensate for, or eliminate, the adverse effects caused by manufacturing tolerances, or wear and tear, on the bucking or other components of the loading mechanism.

A loading mechanism in accordance with one or more aspects of the present disclosure includes a housing including a loading chamber positioned adjacent to a housing passageway. The loading chamber is operable to load ammunition therein. A resilient bucking is disposed within the housing passageway. The bucking includes a bucking passageway that is operable to receive ammunition transferred from the loading chamber. A spring, having a plurality of spring coils, is disposed in the housing passageway. The spring is operable to apply pressure to the bucking when the spring is compressed. A gun barrel is slidably positioned within the housing passageway. A fastening mechanism is operable to attach the gun barrel to the housing and to put the spring into compression. When the spring is compressed, pressure is applied to the bucking and the bucking passageway is collapsed inward to seal entirely around ammunition that is positioned within the bucking passageway.

In some examples of the loading mechanism the fastening mechanism includes an unadjustable cap that attaches flush up against the housing and applies pressure on the spring.

In some examples of the loading mechanism the fastening mechanism includes a threaded adjustable cap having a plurality of threads that mate to a corresponding plurality of threads on the gun barrel. The amount of pressure applied to the spring and bucking is adjustable by the amount of engaged threads on the adjustable cap that are engaged to the threads on the gun barrel.

In some examples of the loading mechanism there is included a tapered sleeve disposed within the housing. The tapered sleeve has a sleeve passageway that tapers from a first opening diameter to a smaller second opening diameter. The bucking is disposed at least partially through the first opening diameter such that, as more threads are engaged by the fastening mechanism, the bucking is forced deeper into the tapered sleeve passageway.

In some examples of the loading mechanism the housing further includes a tubular receiving section configured to accept sammunition from a magazine of an air gun. The loading chamber has a receiving section opening connected to the receiving section. Ammunition passes through the receiving section opening from the receiving section and into the loading chamber.

In some examples of the loading mechanism there is included a magnet disposed on the housing and positioned above the loading chamber on a side of the housing opposed to the position of the receiving section opening. The magnet is operable to attract and hold magnetic ammunition within the loading chamber of the housing.

In some examples of the loading mechanism the loading chamber has a nozzle opening configured to slidably receive a reciprocating air nozzle. The air nozzle is operable to reciprocate from an extended position to retracted position. When the air nozzle is in its retracted position, the ammunition enters the loading chamber. When the air nozzle is in its extended position, the ammunition is pushed from the loading chamber into the bucking passageway.

In some examples of the loading mechanism the bucking has a first end and a second end with the bucking passageway disposed therebetween. The first end of the bucking is positioned adjacent the loading chamber. The spring has a first end and a second end with the plurality of the spring coils positioned therebetween. The first end of the spring is positioned adjacent the second end of the bucking and the second end of the bucking is positioned adjacent the fastening mechanism.

In some examples of the loading mechanism the barrel of the air gun is positioned within an inner diameter of the spring.

In some examples of the loading mechanism the ammunition is a substantially 4.5 millimeter diameter metal BB.

An air gun in accordance with one or more aspects of the present disclosure includes a loading mechanism for loading metal ammunition into the air gun from a magazine of the air gun. The loading mechanism includes a housing including a loading chamber positioned adjacent to a housing passageway. The loading chamber is operable to load ammunition therein. A resilient bucking is disposed within the housing passageway. The bucking includes a bucking passageway that is operable to receive ammunition transferred from the loading chamber. A spring, having a plurality of spring coils, is disposed in the housing passageway. The spring is operable to apply pressure to the bucking when the spring is compressed. A gun barrel is slidably positioned within the housing passageway. A fastening mechanism is operable to attach the gun barrel to the housing and to put the spring into compression. When the spring is compressed, pressure is applied to the bucking and the bucking passageway is collapsed inward to seal entirely around ammunition that is positioned within the bucking passageway.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DRAWINGS

The disclosure will be more fully understood from the following detailed description taken in conjunction with the accompanying drawings, in which:

FIG. 1A depicts an example of a cross-sectional view of a loading mechanism for loading ammunition into an air gun from a magazine of the air gun via a reciprocating air nozzle, wherein the air nozzle is illustrated in a retracted position and wherein the loading mechanism has an adjustable threaded cap for a fastening mechanism between the gun barrel and the housing of the loading mechanism, according to aspects described herein;

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example may be combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 1A:
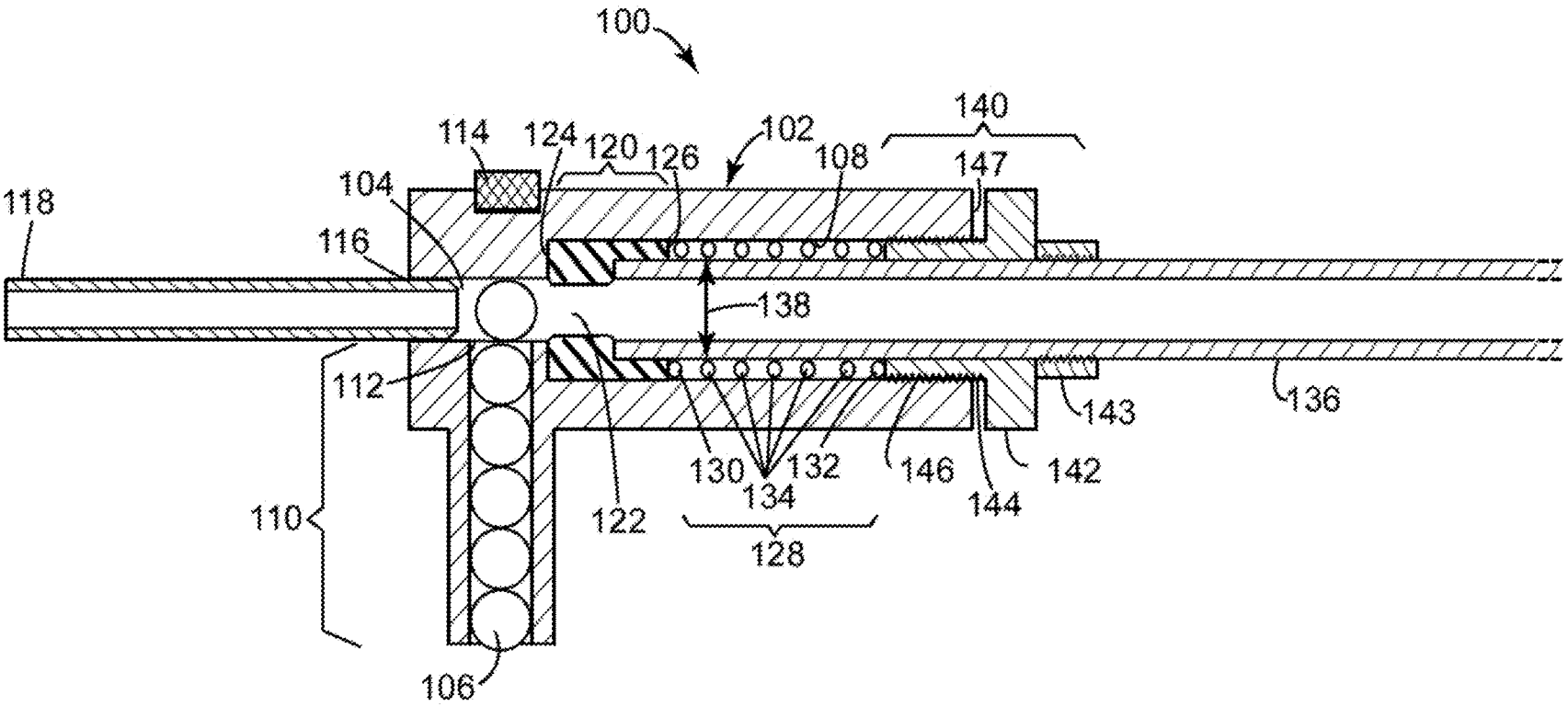
FIG. 1B depicts an example of a cross-sectional view of the loading mechanism of FIG. 1A, wherein the air nozzle is illustrated in an extended position, according to aspects described herein.
Figure 1B:
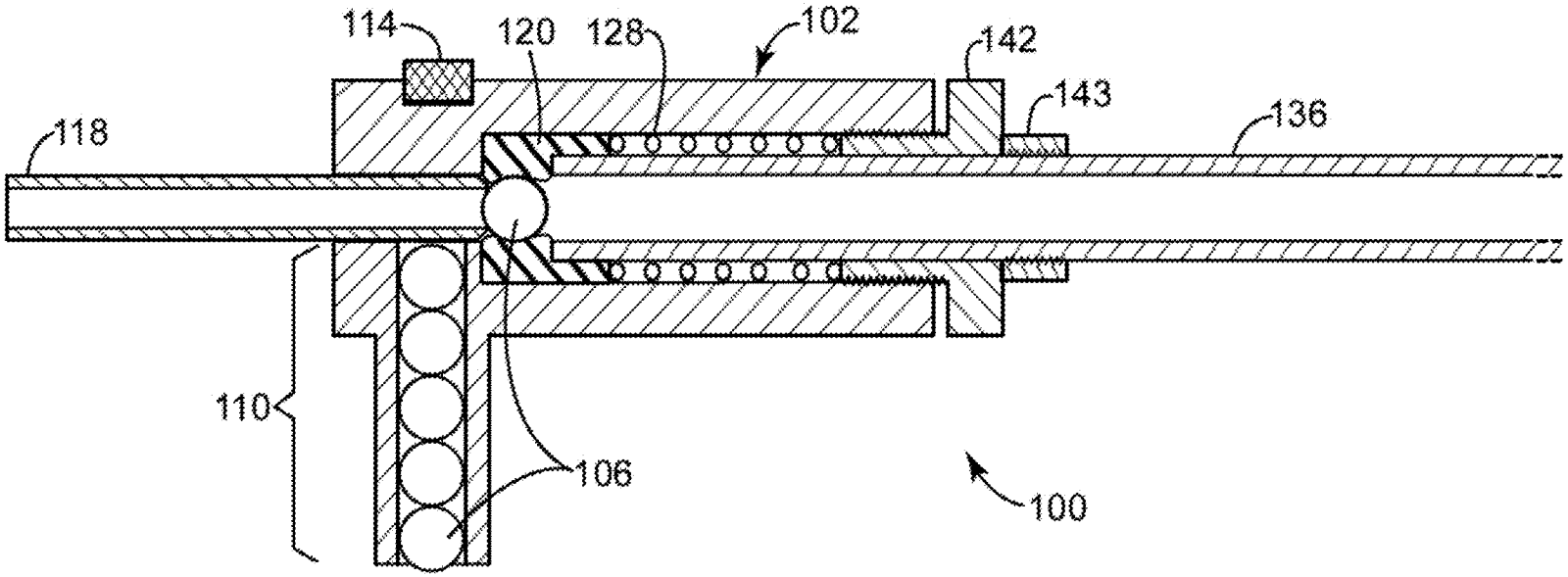

Referring to FIGS. 1A and 1B, an example is depicted of a cross-sectional view of a loading mechanism 100 for loading ammunition 106 into an air gun 200 (see FIG. 5) from a magazine 202 of the air gun 200 via a reciprocating air nozzle 118. The air nozzle 118 is illustrated in a retracted position in FIG. 1A. The air nozzle 118 is illustrated in an extended position in FIG. 1B. The loading mechanism 100 has an adjustable threaded cap 142 for a fastening mechanism 140 between a gun barrel 136 and a housing 102 of the loading mechanism 100, according to aspects described herein.

Figure 2:
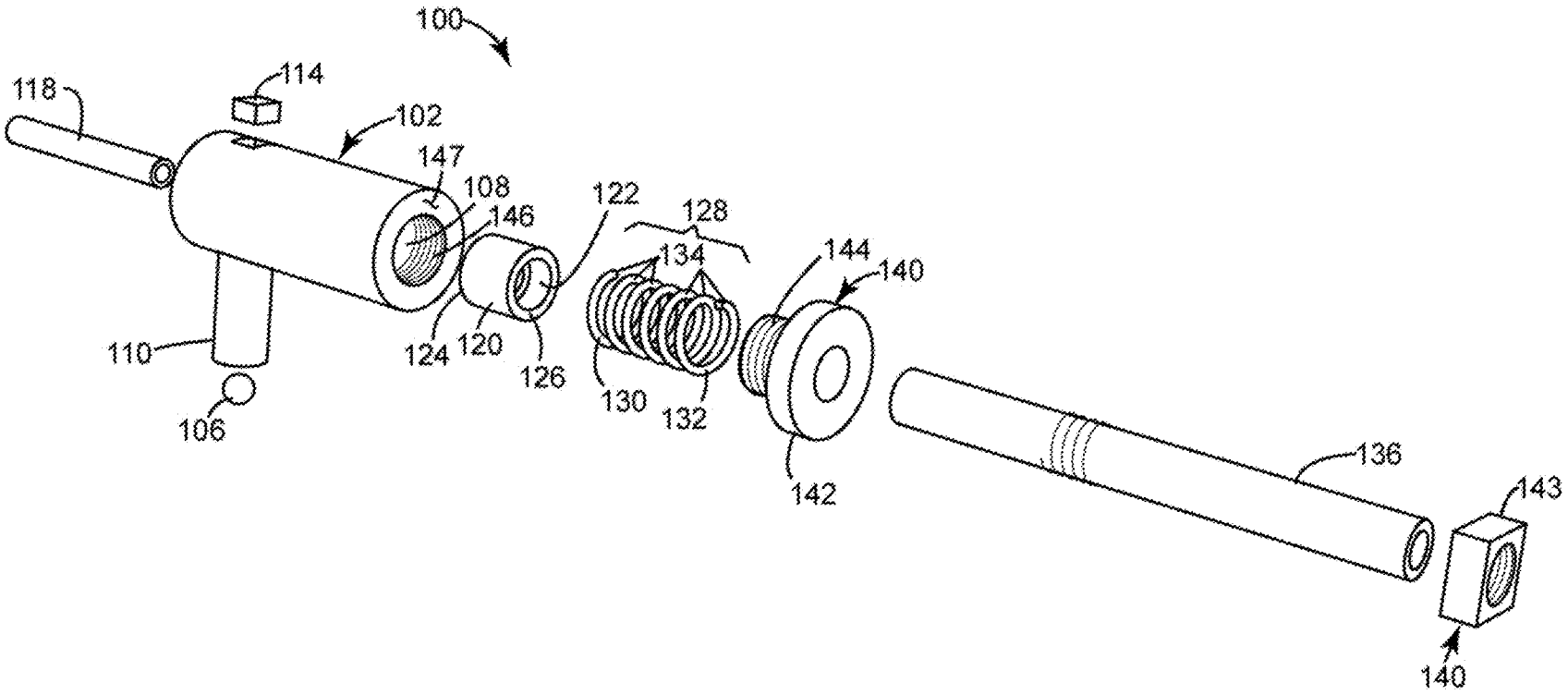
FIG. 2 depicts an example of an exploded perspective view of the loading mechanism of FIGS. 1A and 1B, according to aspects described herein.

Also Referring to FIG. 2, an example is depicted of an exploded perspective view of the loading mechanism of FIGS. 1A and 1B, according to aspects described herein.

The loading mechanism 100 in FIGS. 1A, 1B and 2 includes a housing 102, which includes a loading chamber 104 for loading ammunition 106, and preferably magnetic ammunition, therein. The housing 102 also includes a housing passageway 108 that is positioned adjacent to the loading chamber 104.

The loading chamber 104 is operable to load ammunition 106 therein. The ammunition 106 may be any sized BB or other type of spherical ammunition. For example, the ammunition 106 may be BBs that are substantially 4.5 millimeter (mm) diameter metal BBs.

The ammunition 106 may also be other types of non-spherical ammunition, such as pellets. For example, such pellets, or other types of non-spherical ammunition, may have a head section that may be composed of various types of metals, wherein the head section carries most of the mass of the non-spherical. Additionally, such non-spherical ammunition may include a hollow, tapered skirt section that is designed for creating drag. The section of the non-spherical ammunition between the skirt section and the head section is often called the waist section, which may have a smaller diameter than the rest of the non-spherical ammunition.

Figure 5:
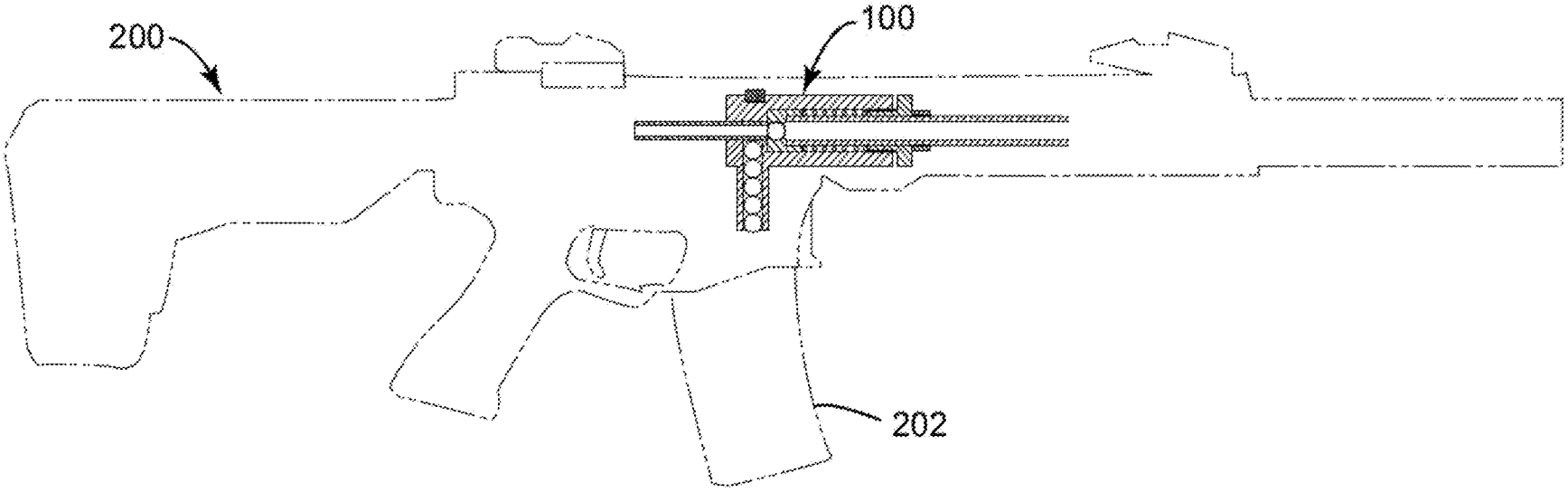
FIG. 5 depicts an example of a side plan view of an air gun having a loading mechanism disposed therein, according to aspects described herein.

The housing 102 further comprising a tubular receiving section 110, which is configured to accept the ammunition 106 from a magazine 202 of an air gun 200 (see FIG. 5). In the example illustrated in FIG. 1, the receiving section 110 is oriented at approximately a right angle (i.e., substantially 90 degrees relative) to the housing passageway 108. However, the receiving section 110 may be oriented at other angles relative to the housing passageway 108.

The loading chamber 104 has a receiving section opening 112 that is connected to the receiving section 110. During operation, the ammunition passes 106 passes through the receiving section opening 112 from the receiving section 110 into the loading chamber 104.

A magnet 114 is disposed on the housing 102 and positioned above the loading chamber 104 on a side of the housing 102 that is opposed to the position of the receiving section opening 112. The magnet 114 is operable to attract and hold the ammunition 106 within the loading chamber 104 of the housing 102, when the ammunition 106 is composed of a magnetic material that is capable of being attracted by a magnet (e.g., steel, iron or the like). The magnet 114 assures that the ammunition 106 is properly positioned within the loading chamber 104, such that it the ammunition is aligned with the housing passageway 108 and ready to be launched therethrough.

The loading chamber 104 of the housing 102 has a nozzle opening 116 that is configured to slidably receive a reciprocating air nozzle 118. The air nozzle 118 is operable to reciprocate from an extended position (see FIG. 1B) to retracted position (see FIG. 1A). When the air nozzle 118 is in its retracted position (as shown in FIG. 1A), the ammunition 106 is pulled by the magnet 114 and enters the loading chamber 104 from the receiving section 110.

When the air nozzle 118 is in its extended position (as shown in FIG. 1B), the ammunition 106 is pushed from the loading chamber 104 into the housing passageway 108. More specifically, as will be discussed in greater detail herein, when the air nozzle 118 is in its extended position (see FIG. 1B), the ammunition 106 is pushed from the loading chamber 104 into a bucking passageway 122 of a bucking 120 that is positioned within the housing passageway 108 adjacent the loading chamber 104.

The bucking 120 is disposed within the housing passageway 108 and is composed of a resilient material, such as rubber, neoprene or the like. The bucking 120 includes a bucking passageway 122, which is operable to receive the ammunition 106 transferred from the loading chamber 104. The bucking 120 has a first end 124 and a second end 126 with the bucking passageway 122 disposed therebetween. The first end 124 of the bucking 120 is positioned adjacent to the loading chamber 104. When the reciprocating air nozzle 118 extends into its extended position (see FIG. 1B), the nozzle 118 pushes the ammunition (such as a BB) 106 from the loading chamber 104 into the bucking passageway 122 of the bucking 120. The bucking passageway 122 is sized to frictionally fit around the BB 106 and to grip around the entire circumference of the BB 106.

The loading mechanism 100 also includes a spring 128 having a first end 130 and a second end 132 with a plurality of coils 134 therebetween. The spring 128 is disposed in the housing passageway 108 and is operable to apply pressure to the bucking 120 when the spring 128 is compressed. The first end 130 of the spring 120 is positioned adjacent the second end 126 of the bucking 120 and the second end 132 of the spring 128 is positioned adjacent to a fastening mechanism 140.

The loading mechanism 100 also includes a gun barrel 136 that is slidably positioned within the housing passageway 108. More specifically, in the example illustrated in FIG. 1, the gun barrel 136 is positioned within an inner diameter 138 of the spring 128.

The loading mechanism 100 also includes a fastening mechanism 140, which is operable to attach the gun barrel 136 to the housing 102 and to put the spring 128 into compression. As will be discussed in greater detail herein, when the spring 128 is compressed, pressure is applied to the bucking 120 and the bucking passageway 122 is collapsed inward to seal entirely around ammunition 106 that is positioned within the bucking passageway 122.

In the example illustrated in FIG. 1, the fastening mechanism 140 includes a threaded adjustable cap 142 attached to the gun barrel 136. The threaded adjustable cap 142 has a plurality of threads 144 that mate to a corresponding plurality of threads 146 on the housing 102. More specifically, the adjustable threaded cap 142 has a plurality of male threads 144 that mate with a corresponding plurality of female threads 146 on a distal end 147 of the housing passageway 108 of the housing 102. The adjustable cap 142 extends into the housing passageway 108 and presses against the second end 132 of the spring 128, therefore urging the spring 128 into compression. The first end 130 of the spring 128 is, accordingly, urged against the second end 126 of the bucking 120 to apply pressure to the bucking 120. The amount of pressure applied to the spring and bucking is adjustable by the amount of threads 144 on the adjustable cap 142 that are engaged to the threads 146 on the housing 102. Once the adjustable cap 142 is adjusted to a desired position, the adjustable cap 142 may be locked into position by a lock nut 143 or other appropriate locking mechanism.

During operation, the pressure exerted on the bucking 120 by the spring 128 will cause the bucking passageway 122 to collapse inwardly around the BB 106 or any other spherical or non-spherical ammunition 106. This is because, the inner circumferential walls of the housing passageway 108 will prevent the bucking 120 from expanding outwardly. Accordingly, the bucking passageway 122 of the flexible bucking 120 will be forced to constrict evenly and inwardly around the ammunition 106.

The bucking passageway 122 will form a substantially air-tight restrictive seal around the entire BB 106. The seal will hold until the back pressure from the air nozzle 118 builds up to a point where the air pressure from the air nozzle 118 overcomes the resistive seal from the bucking 120, whereupon the ammunition 106 is launched out of the gun barrel 136.

Advantageously, the sealing force applied by the bucking 120 to the ammunition 106 may be adjusted by either changing the spring, changing the amount of threads engaged between the adjustable cap 142 and housing 102 or both. Moreover, the hysteresis from the combination of the spring 128 and threaded adjustable cap 142, enables an advantageously fine tuning capability on the sealing force that is finer than what either of the spring 128 or the threaded adjustable cap 142 could accomplish separately.

If the bucking 120 gets worn due to wear and tear, the adjustable cap 142 can be adjusted or the spring 128 can be changed to adjust the sealing pressure of the bucking 120 onto the ammunition. 106. Additionally if, due to manufacturing tolerances, a new bucking 120 is not optimally sized, the adjustable cap 142 and/or spring 128 can be adjusted to accommodate for those manufacturing tolerances.

Moreover, if the air pressure pump (not shown) is changed or upgraded such that the pump's output pressure is different, then the spring 128 and/or adjustable cap 142 can be adjusted to more optimally match the sealing pressure applied by the bucking 120 to the pump's air pressure.

In the example of a loading mechanism 100 illustrated in FIG. 1, the spring 128 is shown in direct contact with the bucking 120 and the fastening mechanism 140 (the adjustable cap 142 as illustrated). However, there may be other structure, such as washers or the like, that may be imposed between the spring 128 and the adjustable cap 142 or between the spring 128 and bucking 120.

Figure 3A:
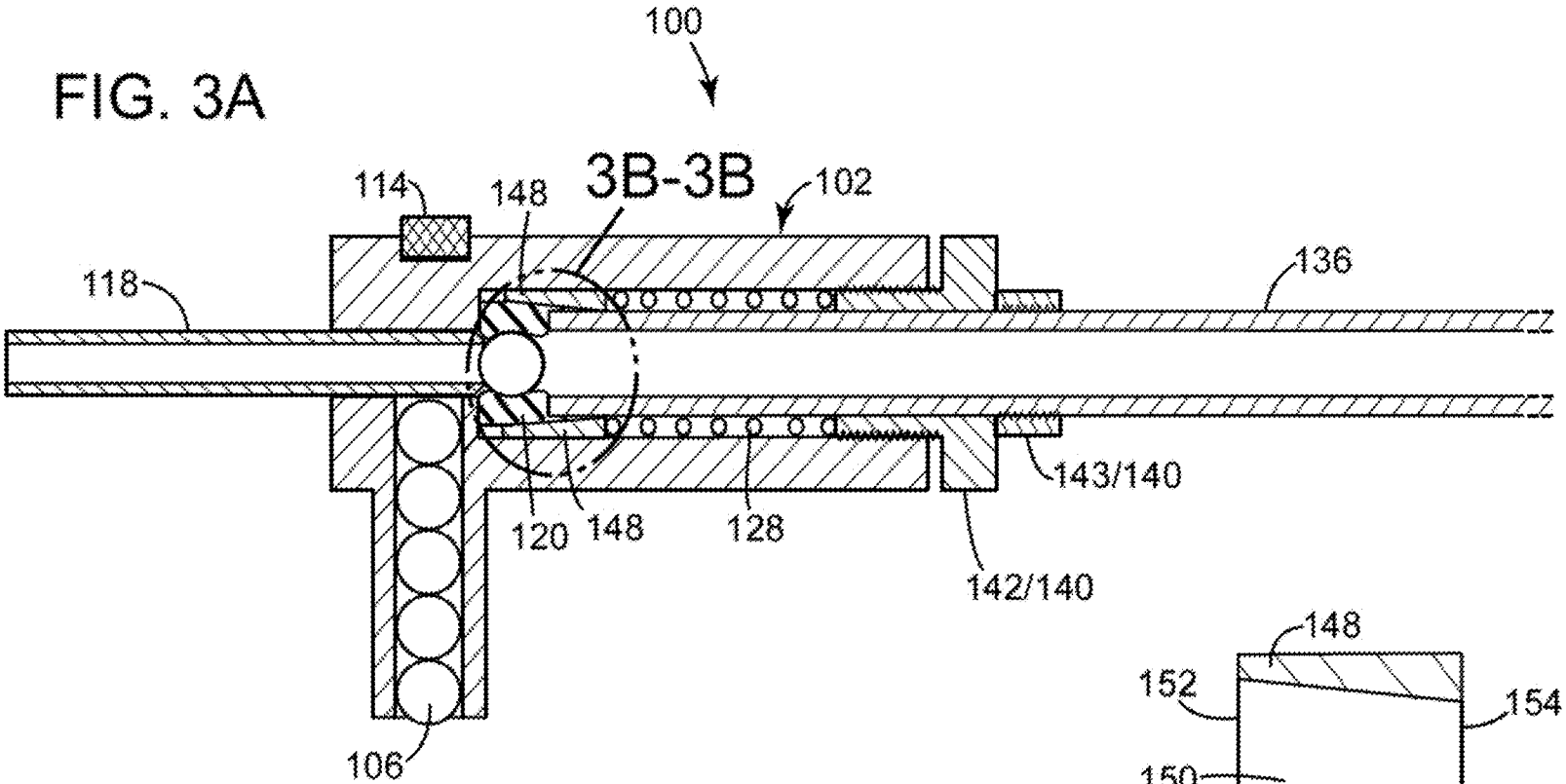
FIG. 3A depicts an example of a cross-sectional view of the loading mechanism of FIGS. 1A and 1B with a tapered sleeve disposed within the housing of the loading mechanism and between the bucking and the spring of the loading mechanism, according to aspects described herein.
Figure 3B:
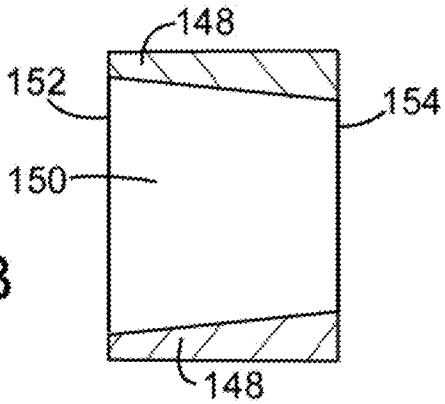
FIG. 3B depicts an example of an expanded cross-sectional view of the tapered sleeve of FIG. 3A, according to aspects described herein.

Referring to FIGS. 3A and 3B, an example is depicted of a cross-sectional view of the loading mechanism 100 of FIG. 1 (FIG. 3A) with a tapered sleeve 148 disposed within the housing 102 of the loading mechanism 100, and an example is also depicted of an expanded cross-sectional view of the tapered sleeve 148 (FIG. 3B) within the area of circle 3B-3B of FIG. 3A, according to aspects described herein. The tapered sleeve 148 is positioned between the bucking 120 and the spring 128 of the loading mechanism 100.

The tapered sleeve 148 is disposed within the housing 102 of the loading mechanism 100. The tapered sleeve 148 has a sleeve passageway 150 that tapers from a first opening 152, having a first opening diameter, to a smaller second opening 154, having a smaller second opening diameter. In this example, the bucking 120 is disposed at least partially through the first opening diameter 152 such that, as more threads are engaged by the fastening mechanism 140, the bucking 120 is forced deeper into the tapered sleeve passageway 150. The more the bucking 120 is forced into the tapered sleeve passageway 150, the greater the sealing pressure exerted by the bucking 120 on the ammunition 106 in the bucking passageway 122.

Figure 4:
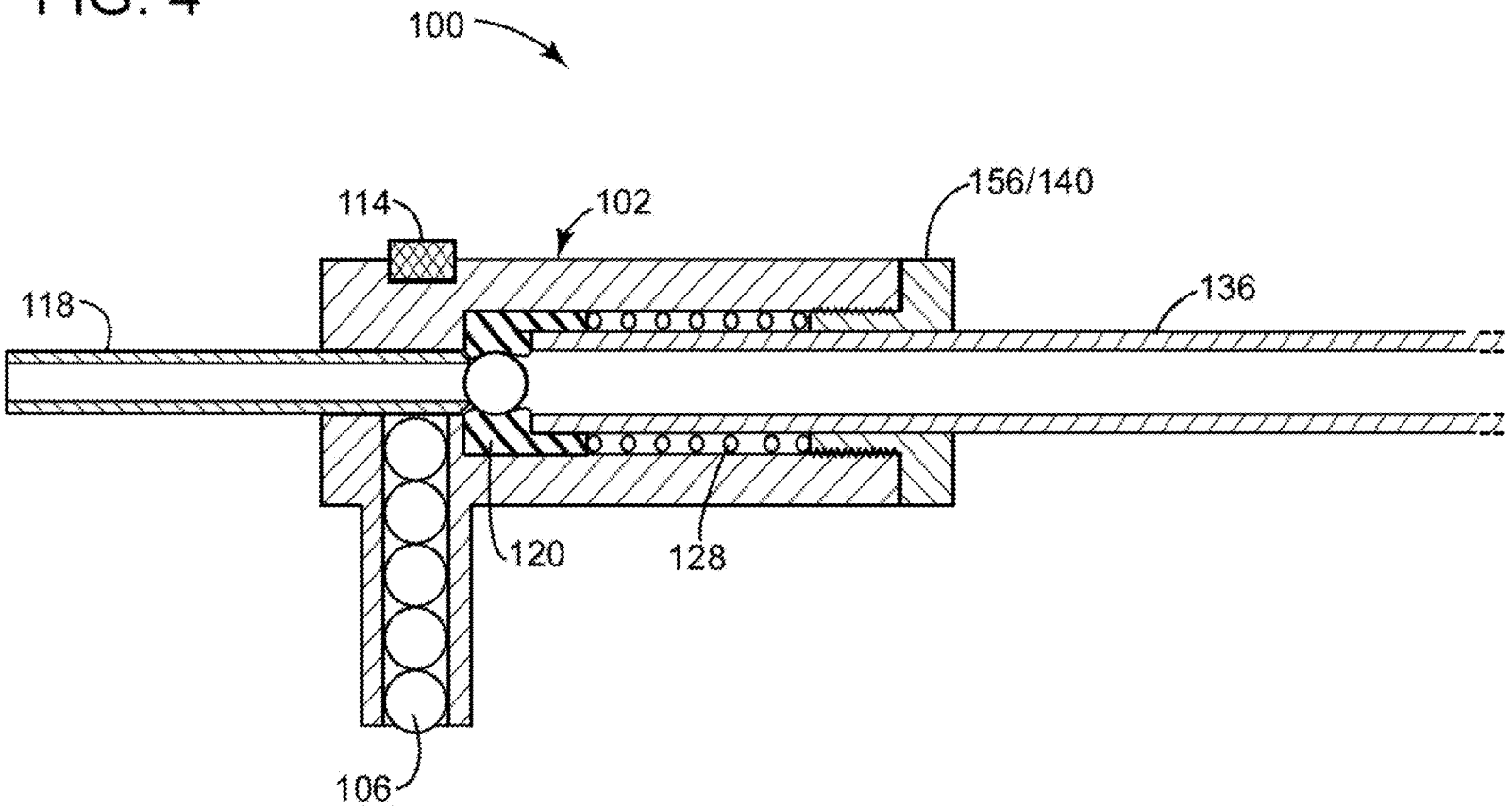
FIG. 4 depicts an example of a cross-sectional view of a loading mechanism having an unadjustable cap for a fastening mechanism between a gun barrel and a housing of the loading mechanism, according to aspects described herein.

Referring to FIG. 4, an example is depicted of a cross-sectional view of the loading mechanism 100 having an unadjustable cap 156 for a fastening mechanism 140 between the gun barrel 136 and the housing 102 of the loading mechanism 100, according to aspects described herein. In the example illustrated in FIG. 4, the fastening mechanism 140 includes the unadjustable cap 156, which attaches flush up against the distal end 147 of the housing 102 and is torqued into place. The unadjustable cap 156 also applies a constant pressure on the spring 128.

Though the example illustrated in FIG. 4 shows an unadjustable cap 156, other types of unadjustable fastening mechanisms may also be used to hold the spring 128 in a relatively constant compression pressure. For example, the fastening mechanism may include a clip, a pin, a retaining ring or the like.

In the example illustrated in FIG. 4, the unadjustable cap 156, or other types of unadjustable fastening mechanisms, do not have an adjustment capability. Even so, the spring 128 can be changed out for another spring 128 to accommodate changing conditions due to, for example, normal wear and tear or manufacturing tolerance.

Referring to FIG. 5, an example is depicted of a side plan view of an air gun 200 having the loading mechanism 100 disposed therein, according to aspects described herein. As illustrated, the loading mechanism 100 has its receiving section 110 connected to the magazine 202 of the air gun 200. Additionally, the loading mechanism has it housing passageway 108 connected, and in direct alignment with, the barrel 136 of the air gun 200.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. A loading mechanism comprising:

a housing comprising a loading chamber positioned adjacent to a housing passageway, the loading chamber operable to load ammunition therein;

a resilient bucking disposed within the housing passageway, the bucking comprising a bucking passageway operable to receive ammunition transferred from the loading chamber;

a spring having a plurality of spring coils, the spring disposed in the housing passageway and operable to apply pressure to the bucking when the spring is compressed;

a gun barrel slidably positioned within the housing passageway, wherein the barrel of the air gun is positioned within an inner diameter of the spring; and a fastening mechanism operable to attach the gun barrel to the housing and to put the spring into compression;

wherein, when the spring is compressed, pressure is applied to the bucking and the bucking passageway is collapsed inward to seal entirely around ammunition that is positioned within the bucking passageway.

2. The loading mechanism of claim 1, wherein the fastening mechanism comprises an unadjustable cap that attaches flush up against a distal end of the housing and applies pressure on the spring.

3. The loading mechanism of claim 1, wherein the fastening mechanism comprises:

a threaded adjustable cap attached to the gun barrel, the threaded adjustable cap having a plurality of threads that mate to a corresponding plurality of threads on the housing; and wherein the amount of pressure applied to the spring and bucking is adjustable by the amount of threads on the adjustable cap that are engaged to the threads on the housing.

4. The loading mechanism of claim 3, comprising:

a tapered sleeve disposed within the housing, the tapered sleeve having a sleeve passageway that tapers from a first opening to a smaller second opening;

wherein the bucking is disposed at least partially through the first opening such that, as more threads are engaged by the fastening mechanism, the bucking is forced deeper into the tapered sleeve passageway.

5. The loading mechanism of claim 1, comprising:

the housing further comprising a tubular receiving section configured to accept ammunition from a magazine of an air gun;

the loading chamber having a receiving section opening connected to the receiving section and through which the ammunition passes from the receiving section into the loading chamber.

6. The loading mechanism of claim 5, comprising:

a magnet disposed on the housing and positioned above the loading chamber on a side of the housing opposed to the position of the receiving section opening, the magnet operable to attract and hold magnetic ammunition within the loading chamber of the housing.

7. The loading mechanism of claim 1, comprising:

the loading chamber having a nozzle opening configured to slidably receive a reciprocating air nozzle that is operable to reciprocate from an extended position to retracted position;

wherein, when the air nozzle is in its retracted position, the ammunition enters the loading chamber, and wherein when the air nozzle is in its extended position, the ammunition is pushed from the loading chamber into the bucking passageway.

8. The loading mechanism of claim 1, comprising:

the bucking having a first end and a second end with the bucking passageway disposed therebetween, wherein the first end of the bucking is positioned adjacent the loading chamber; and the spring having a first end and a second end with the plurality of the spring coils positioned therebetween, wherein the first end of the spring is positioned adjacent the second end of the bucking and the second end of the spring is positioned adjacent the fastening mechanism.

9. The loading mechanism of claim 1, wherein the ammunition is a substantially 4.5 millimeter diameter metal BB.

10. An air gun comprising having a loading mechanism for loading metal ammunition into the air gun from a magazine of the air gun, the loading mechanism comprising:

a housing comprising a loading chamber positioned adjacent to a housing passageway, the loading chamber operable to load ammunition therein;

a resilient bucking disposed within the housing passageway, the bucking comprising a bucking passageway operable to receive ammunition transferred from the loading chamber;

a spring having a plurality of spring coils, the spring disposed in the housing passageway and operable to apply pressure to the bucking when the spring is compressed;

a gun barrel slidably positioned within the housing passageway, wherein the barrel of the air gun is positioned within an inner diameter of the spring; and a fastening mechanism operable to attach the gun barrel to the housing and to put the spring into compression;

wherein, when the spring is compressed, pressure is applied to the bucking and the bucking passageway is collapsed inward to seal entirely around ammunition that is positioned within the bucking passageway.

11. The air gun of claim 10, wherein the fastening mechanism comprises an unadjustable cap that attaches flush up against a distal end of the housing and applies pressure on the spring.

12. The air gun of claim 10, wherein the fastening mechanism comprises:

a threaded adjustable cap attached to the gun barrel, the threaded adjustable cap having a plurality of threads that mate to a corresponding plurality of threads on the housing; and wherein the amount of pressure applied to the spring and bucking is adjustable by the amount of engaged threads on the adjustable cap that are engaged to the threads on the housing.

13. The air gun of claim 12, comprising:

a tapered sleeve disposed within the housing, the tapered sleeve having a sleeve passageway that tapers from a first opening to a smaller second opening;

wherein the bucking is disposed at least partially through the first opening such that, as more threads are engaged by the fastening mechanism, the bucking is forced deeper into the tapered sleeve passageway.

14. The air gun of claim 10, comprising:

the housing further comprising a tubular receiving section configured to accept ammunition from a magazine of an air gun;

the loading chamber having a receiving section opening connected to the receiving section and through which the ammunition passes from the receiving section into the loading chamber.

15. The air gun of claim 14, comprising:

a magnet disposed on the housing and positioned above the loading chamber on a side of the housing opposed to the position of the receiving section opening, the magnet operable to attract and hold the metal ammunition within the loading chamber of the housing.

16. The air gun of claim 10, comprising:

the loading chamber having a nozzle opening configured to slidably receive a reciprocating air nozzle that is operable to reciprocate from an extended position to retracted position;

wherein, when the air nozzle is in its retracted position, the ammunition enters the loading chamber, and wherein when the air nozzle is in its extended position, the ammunition is pushed from the loading chamber into the bucking passageway.

17. The air gun of claim 10, comprising:

the bucking having a first end and a second end with the bucking passageway disposed therebetween, wherein the first end of the bucking is positioned adjacent the loading chamber; and the spring having a first end and a second end with the plurality of the spring coils positioned therebetween, wherein the first end of the spring is positioned adjacent the second end of the bucking and the second end of the spring is positioned adjacent the fastening mechanism.

18. The air gun of claim 10, wherein the ammunition is a substantially 4.5 millimeter diameter metal BB.

19. A loading mechanism comprising:

a housing comprising a loading chamber positioned adjacent to a housing passageway, the loading chamber operable to load ammunition therein;

a resilient bucking disposed within the housing passageway, the bucking comprising a bucking passageway operable to receive ammunition transferred from the loading chamber;

a spring having a plurality of spring coils, the spring disposed in the housing passageway and operable to apply pressure to the bucking when the spring is compressed;

a gun barrel slidably positioned within the housing passageway; and a threaded adjustable cap operable to attach the gun barrel to the housing and to put the spring into compression, the threaded adjustable cap having a plurality of threads that mate to a corresponding plurality of threads on the housing;

wherein, when the spring is compressed, pressure is applied to the bucking and the bucking passageway is collapsed inward to seal entirely around ammunition that is positioned within the bucking passageway; and wherein the amount of pressure applied to the spring and bucking is adjustable by the amount of threads on the adjustable cap that are engaged to the threads on the housing.

20. The loading mechanism of claim 19, comprising:

a tapered sleeve disposed within the housing, the tapered sleeve having a sleeve passageway that tapers from a first opening to a smaller second opening;

wherein the bucking is disposed at least partially through the first opening such that, as more threads are engaged by the fastening mechanism, the bucking is forced deeper into the tapered sleeve passageway.

21. An air gun comprising having a loading mechanism for loading metal ammunition into the air gun from a magazine of the air gun, the loading mechanism comprising:

a housing comprising a loading chamber positioned adjacent to a housing passageway, the loading chamber operable to load ammunition therein;

a resilient bucking disposed within the housing passageway, the bucking comprising a bucking passageway operable to receive ammunition transferred from the loading chamber;

a spring having a plurality of spring coils, the spring disposed in the housing passageway and operable to apply pressure to the bucking when the spring is compressed;

a gun barrel slidably positioned within the housing passageway; and a threaded adjustable cap operable to attach the gun barrel to the housing and to put the spring into compression, the threaded adjustable cap having a plurality of threads that mate to a corresponding plurality of threads on the housing;

wherein, when the spring is compressed, pressure is applied to the bucking and the bucking passageway is collapsed inward to seal entirely around ammunition that is positioned within the bucking passageway; and wherein the amount of pressure applied to the spring and bucking is adjustable by the amount of threads on the adjustable cap that are engaged to the threads on the housing.

22. The air gun of claim 21, comprising:

a tapered sleeve disposed within the housing, the tapered sleeve having a sleeve passageway that tapers from a first opening to a smaller second opening;

wherein the bucking is disposed at least partially through the first opening such that, as more threads are engaged by the fastening mechanism, the bucking is forced deeper into the tapered sleeve passageway.

23. A loading mechanism comprising:

a housing comprising a loading chamber positioned adjacent to a housing passageway, the loading chamber operable to load ammunition therein;

a resilient bucking disposed within the housing passageway, the bucking comprising a bucking passageway operable to receive ammunition transferred from the loading chamber, the bucking having a first end and a second end with the bucking passageway disposed therebetween, wherein the first end of the bucking is positioned adjacent the loading chamber;

a spring having a first end and a second end with a plurality of the spring coils positioned therebetween, the spring disposed in the housing passageway and operable to apply pressure to the bucking when the spring is compressed;

a gun barrel slidably positioned within the housing passageway; and a fastening mechanism operable to attach the gun barrel to the housing and to put the spring into compression;

wherein the first end of the spring is positioned adjacent the second end of the bucking and the second end of the spring is positioned adjacent the fastening mechanism; and wherein, when the spring is compressed, pressure is applied to the bucking and the bucking passageway is collapsed inward to seal entirely around ammunition that is positioned within the bucking passageway.

24. An air gun comprising having a loading mechanism for loading metal ammunition into the air gun from a magazine of the air gun, the loading mechanism comprising:

a housing comprising a loading chamber positioned adjacent to a housing passageway, the loading chamber operable to load ammunition therein;

a resilient bucking disposed within the housing passageway, the bucking comprising a bucking passageway operable to receive ammunition transferred from the loading chamber, the bucking having a first end and a second end with the bucking passageway disposed therebetween, wherein the first end of the bucking is positioned adjacent the loading chamber;

a spring having a first end and a second end with a plurality of the spring coils positioned therebetween, the spring disposed in the housing passageway and operable to apply pressure to the bucking when the spring is compressed;

a gun barrel slidably positioned within the housing passageway; and a fastening mechanism operable to attach the gun barrel to the housing and to put the spring into compression;

wherein the first end of the spring is positioned adjacent the second end of the bucking and the second end of the spring is positioned adjacent the fastening mechanism; and wherein, when the spring is compressed, pressure is applied to the bucking and the bucking passageway is collapsed inward to seal entirely around ammunition that is positioned within the bucking passageway.

* * * * *